US008753232B2

(12) United States Patent
Edwards

(10) Patent No.: US 8,753,232 B2
(45) Date of Patent: Jun. 17, 2014

(54) ELASTOMERIC-COATED SPORTS RACKET SWING WEIGHT WITH QUICK RELEASE KNOB HANDLE

(76) Inventor: Steven A. Edwards, North Richland Hills, TX (US)

( * ) Notice: Subject to any disclaimer, the term of this patent is extended or adjusted under 35 U.S.C. 154(b) by 23 days.

(21) Appl. No.: 13/545,839

(22) Filed: Jul. 10, 2012

(65) Prior Publication Data

US 2013/0017910 A1 Jan. 17, 2013

Related U.S. Application Data

(60) Provisional application No. 61/506,563, filed on Jul. 11, 2011.

(51) Int. Cl.
*A63B 69/38* (2006.01)

(52) U.S. Cl.
USPC ..... 473/437; 473/553; 473/549; 473/522

(58) Field of Classification Search
USPC ..... 473/553, 549, 519, 522, 437, 461, 464, 473/494, 459
See application file for complete search history.

(56) References Cited

U.S. PATENT DOCUMENTS

| | | | | | |
|---|---|---|---|---|---|
| 4,063,730 | A | * | 12/1977 | Bates | 473/463 |
| 4,249,728 | A | * | 2/1981 | Bratt | 473/437 |
| 5,356,137 | A | * | 10/1994 | Carvalho | 473/463 |
| 5,409,217 | A | * | 4/1995 | Bobby | 473/425 |
| 5,944,622 | A | * | 8/1999 | Buck et al. | 473/437 |
| 5,964,671 | A | * | 10/1999 | Edwards et al. | 473/437 |
| 5,993,325 | A | * | 11/1999 | Heyer | 473/256 |
| D420,412 | S | * | 2/2000 | Buck et al. | D21/755 |
| D667,517 | S | * | 9/2012 | Gehrke | D21/753 |
| 2013/0017910 | A1 | * | 1/2013 | Edwards | 473/437 |

* cited by examiner

*Primary Examiner* — Raleigh W Chiu

(57) ABSTRACT

A swing weight training device for stringed sports rackets includes two major parts designed to be secured together from opposing sides of the racket strings, to be quickly secured and removed without damage to the strings. An over-molded elastomeric coating encases a mass, providing a soft surface to grab the strings and keep the swing weight from moving or sliding on the strings. The over-mold material may also cover a portion of an attachment mounting stud that protrudes between the strings. An opposing quick attachment knob receives a portion of the stud projecting through strings, securing the mass with a low friction material that slides easily against the racket's strings without damage and providing a quick but secure attachment of the device to the strings of the racket. The knob may have either a threaded attachment or a quick release mechanism incorporated within the stud attachment system.

12 Claims, 4 Drawing Sheets

ELASTOMERIC-COATED SPORTS RACKET SWING WEIGHT WITH QUICK RELEASE KNOB HANDLE

PRIORITY CLAIM

This application claims priority to U.S. Provisional Patent Application Ser. No. 61/506,563 filed Jul. 11, 2011. The content of the above-identified patent document is hereby incorporated by reference.

TECHNICAL FIELD

The present disclosure relates generally to athletic weighted training devices designed to be connected to a hand held device for striking a ball, specifically a racket with horizontal and lateral strings such as tennis, racket ball, badminton, or squash racket.

BACKGROUND

Sports training devices specifically associated with racket-based sports such as tennis, racket ball squash or badminton include fixed weights added to the racket, used to enhance swing training performance, to increase strength, or to warm up prior to game play. For example, U.S. Pat. No. 3,330,560 to Higdon defines flexible weight holders with pockets that attach to the top of the racket. U.S. Pat. No. 4,000,893 to Evans, U.S. Pat. No. 4,052,061 to Stewart, U.S. Pat. No. 4,142,721 to Faleck et al and U.S. Pat. No. 4,538,812 to Mugford all present variations of designs that connect a weight or multiple weights to the throat of the racket. However, many of these slip and move on or against the racket when swung. Similarly, U.S. Pat. No. 4,671,150 to Schoenwetter presents a weighted racket cover that fits loosely over the strings, allowing it to slap back and forth hitting the strings when used.

U.S. Pat. No. 4,200,285 to Petitti Jr. and U.S. Pat. No. 5,083,777 to Held present designs that connect to the edges of the racket. The weights are on opposing edges of the racket and can be difficult to adjust and balance to achieve the desired swing and warm up performance.

U.S. Pat. No. 5,286,021 to Shaw is a weighted device that connects to the lower end of the racket head, but not the strings. U.S. Pat. No. 4,249,728 to Bratt defines a tennis racket exercise weight assembly consisting of opposing fixed weights attached directly to the strings, but having limited utility. Likewise U.S. Pat. No. 5,944,622 to Brett et al. presents a molded device with a pair of opposing shells each including a grid of nub projection fingers that are specifically designed to grab and hold the strings, but again with limited utility. U.S. Pat. No. 5,964,671 to Edwards et al presents a system consisting of two similar opposing parts that screw or clamp together over the strings, with a gasket next to the strings. This system suggests that the each part contain cavities for the weights, with a plurality of one or more removable weights that attach directly to the strings. In actual use, the two similar parts can be difficult to install on the racket, especially if there are multiple removable weights and gasket pieces. In addition, the gasket material when used on both sides of the strings tends to bind, making the removal of the weight system difficult.

There is, therefore, a need in the art for an improved weight for racket-based sports training.

SUMMARY

A swing weight and training device for stringed sports rackets includes two major parts designed to be quickly secured and removed without damage from the opposing sides of the strings. An over-molded elastomeric coating encasing a mass provides a soft surface to grab the strings and keep the swing weight from moving or sliding on the strings. The over-mold may also cover a portion of attachment mounting stud that protrudes between the strings, providing additional protection to the racket strings. In addition, the elastomeric soft coating reduces the potential of injury and provides protection for the weight and operator when the device is used, stored or contacts other objects. An opposing quick attachment knob receives a portion of the stud projecting through strings, securing the mass with a low friction material that slides easily against the racket's strings without damaging them and providing a quick but secure attachment of the device to the strings of the racket. The knob may have either a threaded attachment or a quick release mechanism incorporated within the stud attachment system. This design provides enhancements to current state of the art by the combination and implementation of an asymmetric weighting system with different materials and properties on the opposing sides of the strings. This instantiation provides a soft over molded unit containing the primary weight with a high friction surface that be compressed and flow around the strings holding the unit in place, and the quick turn or quick release handle. The handle can be comprised of a harder low friction material that can turn easily against the string material or incorporate a washer or bushing that allows easy attachment and removal of the device. The same basic design can be produced in multiple different weights and shapes to adapt to the specific training needs of each sport.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 4, discussed below, and the various embodiments used to describe the principles of the present disclosure in this patent document are by way of illustration only and should not be construed in any way to limit the scope of the disclosure.

Significant advantages over existing weights for racket-based sports training are achieved according to the present disclosure using improved the attachment methods, with a fixed weight system having a low friction or quick attachment knob providing a system that will easily attach against the strings while an elastomeric overmold provides additional properties of protecting one or more of the racket strings, the device and other objects from potential damage during use or storage.

The device is an overall improvement to the current state to the art in racket-based sports training weights, independent of the racket type or style and functional on any type of racket. The design presented herein enhances prior designs by providing a training weight attachment that keeps the benefit a simple asymmetric fixed weight system attached directly to the strings while improving the overall functionality and performance of the device. The ease of use is improved through the addition of an opposing knob or handle, which may be further enhanced with the inclusion of a quick release or attachment mechanism in the knob or attachment stud. In addition, further enhancements over prior designs are achieved in string protection and device usefulness by the incorporation of an over-molded elastomeric material in conjunction with the opposing smooth, low friction surface of the knob. For these reasons, it is advantageous to provide a design that enhances the functionality of a racket weight training device that improves the ease of use in attachment and removal while having a method of protecting the racket strings as well as the device itself.

Figure 1:
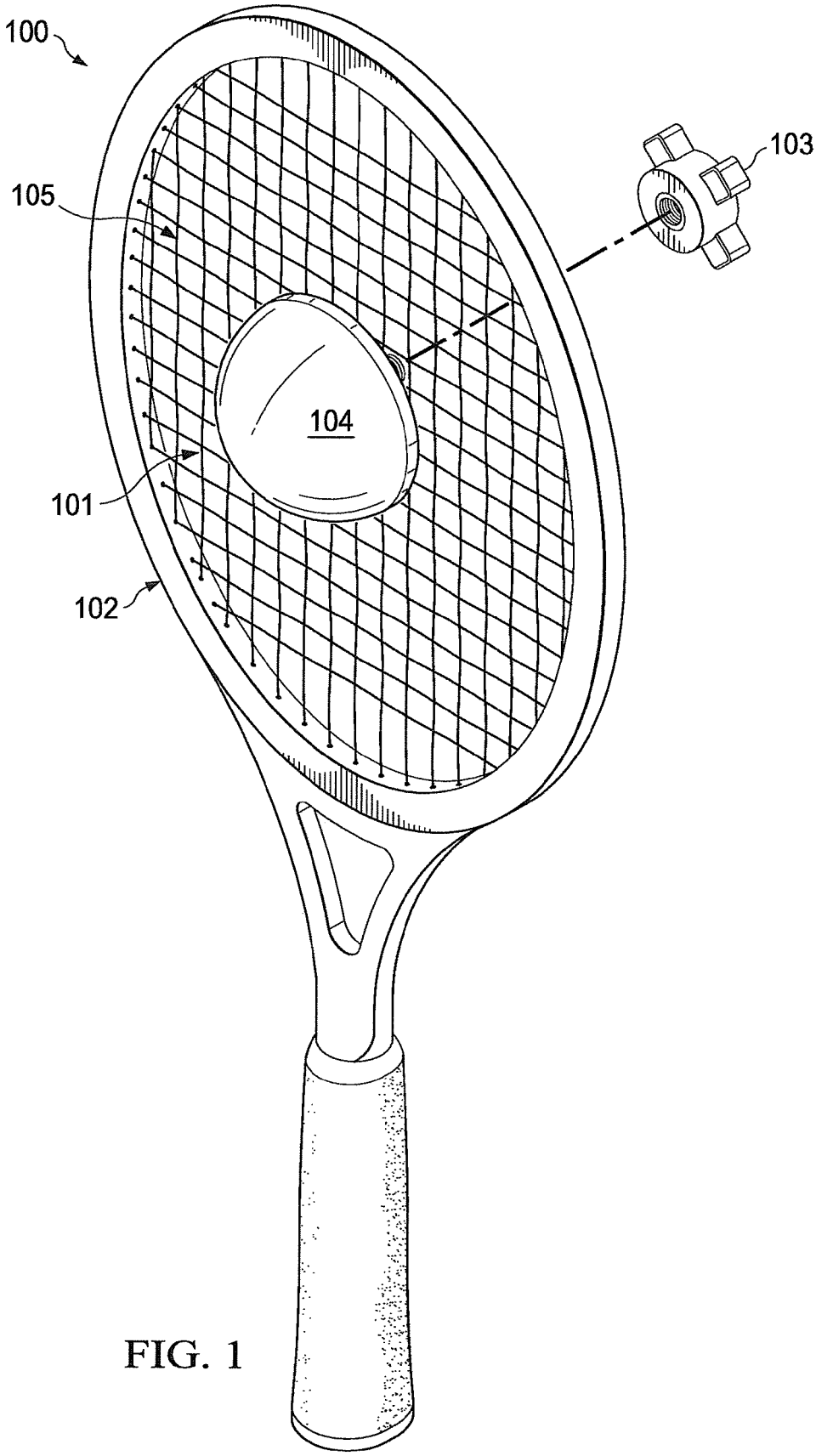
FIG. 1 is an illustration of a swing weight training device attached to strings of a racket with strings according to one embodiment of the present disclosure.

FIG. 1 is an illustration of a swing weight training device attached to strings of a racket with strings according to one embodiment of the present disclosure. The training device embodied by this invention can be of different sizes shapes and weights as desired to meet the needs of the associated sports rackets. The present invention describes the application to a racket such as a tennis racket.

In the isometric view in FIG. 1 of the swing weight training device, the weighted portion of the device 101 is secured to the sports racket 102 by the knob 103. The weight 104 can be secured anywhere on the stringed face 105 of the racket 102. The device 101 is composed of a coated, weighted assembly 104 made of steel or of other suitable materials and an opposing knob or handle 103. The weighted assembly 104 is shown in FIG. 1 as having a smooth hemispherical shape. However, that shape is not required to obtain proper function. Other shapes such as oval, square or triangular would also function. A smooth radius shape is preferably implemented so as to provide maximum protection to the racket, the user or other objects the device may contact. The knob 103 is shown as having a lobed circumference. However, that exact shape of knob is not required for proper function. Many other shapes such as square, star, cross or triangular would also function.

Figure 2A:
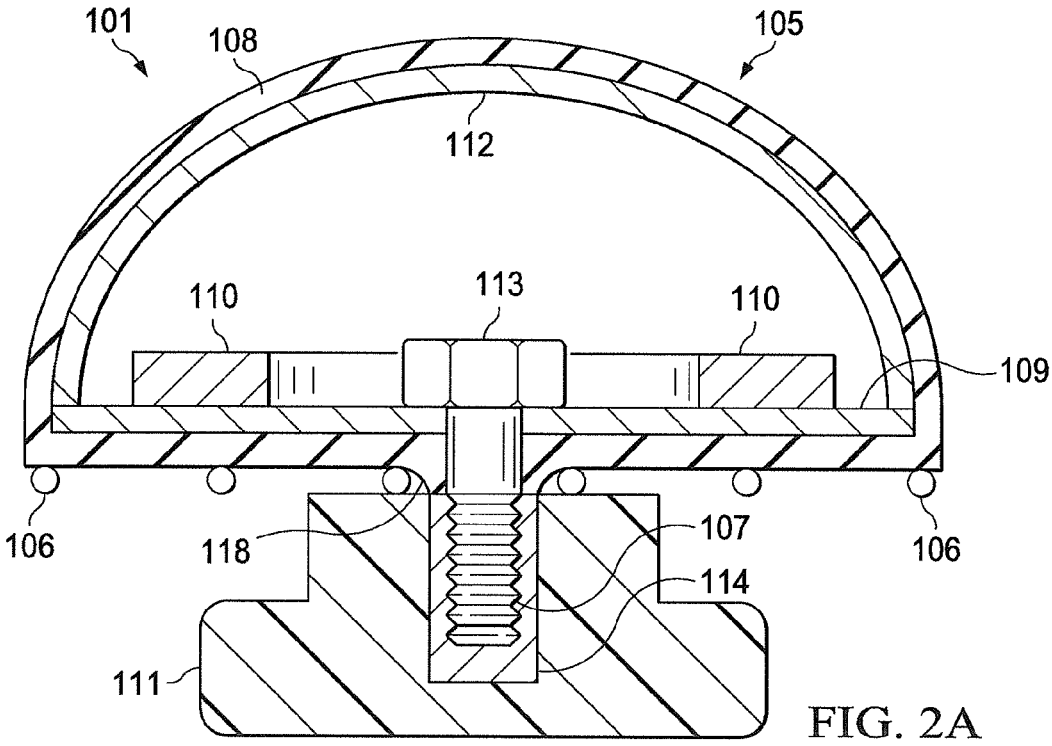
FIGS. 2A and 2B are section views of the swing weight training device of FIG. 1, with the stud attached to the weight and with the stud attached to the knob.
Figure 2B:
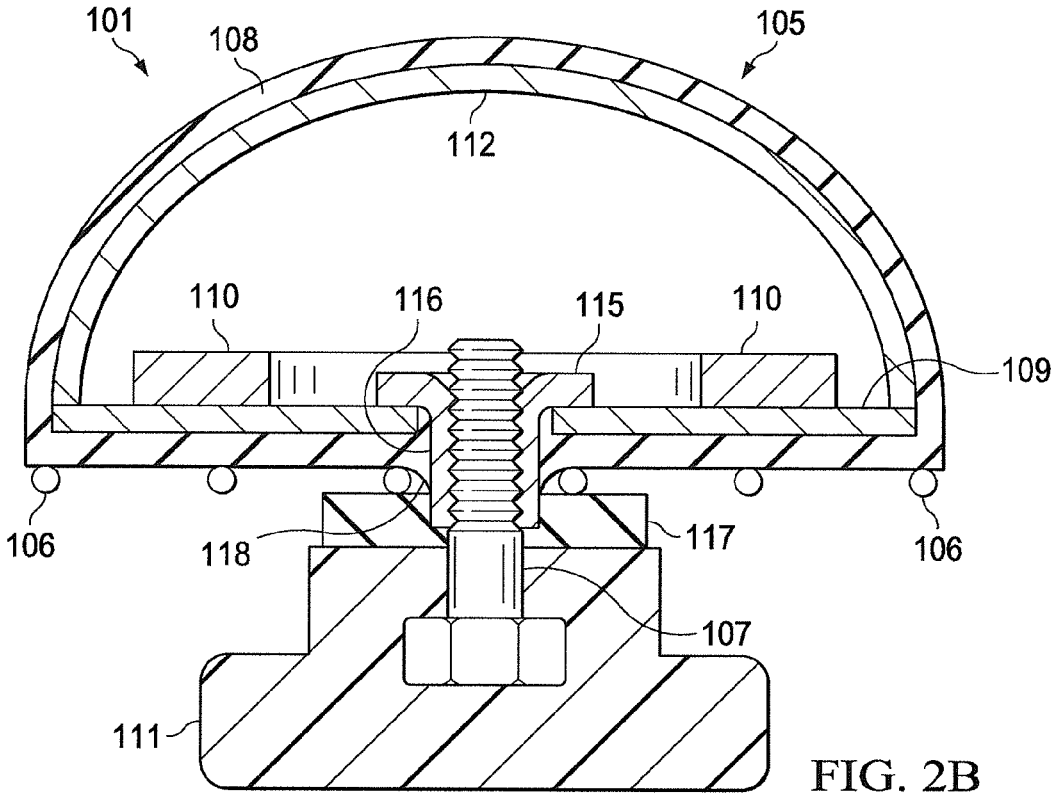

FIGS. 2A and 2B are section views of the swing weight training device of FIG. 1, with the stud attached to the weight and with the stud attached to the knob. The racket sport weighted training device 101 is attached to the strings of the racket. The racket sport weighted training device 101 includes a weighted portion 105 secured to the sports racket strings by a securing knob 111. The attachment stud 107 is shown as a threaded assembly that is passing through gaps in the racket strings 106. The primary weight assembly 105 is comprised of a housing 112, a flat bottom plate 109, an internal fixed weight 110, and either the male stud 113 or female nut 114 of a cooperative threaded assembly. This primary weight assembly 105 is covered with an elastomeric material 108. An extension 118 of the elastomeric coating 108 may protrude from the weight as far as necessary to protect the racket strings 106. If the mounting stud 107 is smooth or small in relation to the gap in the strings 106, the extension 118 of the elastomeric coating 108 onto the stud 107 where the stud protrudes between the strings 106 may be unnecessary. The male portions of the attachment mounting stud 107 could be secured to either the weighted portion 105 as shown in FIG. 2A or to the knob 111 as shown in FIG. 2B to achieve proper function of the device.

In FIG. 2A, the female portion 114 of the attachment mounting stud 107 is within the securing knob 111. In FIG. 2B, the female nut 115, shown as a T-nut, is within the primary weight assembly 105 and provides a surface 116 on which the elastomeric coating 108 may extend to form protrusion 118 protecting the strings 106. As seen in FIG. 2B, the shaft of T-nut 115 may extend beyond the strings. In this application, a gasket washer 117 is preferably included to fill the gap between the strings 106 and the knob 111, preventing the T-nut from contacting the knob 111. This ensures a sufficient clamping force to hold the swing weight assembly securely to the racket strings 106.

A flat bottom plate 109 provides a smooth solid backing surface where the elastomeric coating 108 is against the strings 106. This flat plate 109, when covered with the elastomeric coating 108, provides a large, pliable, high friction surface area that conforms to the strings 106, preventing the device from moving when the compression forces is applied by the securing knob 111. This eliminates damage to the strings when the opposing knob 111 is attached to the racket and the device is used as training device. The desired final mass of the weight 105 is achieved by adding internal fixed weights 110 at the time of initial assembly, allowing multiple different units of mass to be provided with the same or similar physical dimensions by the inclusion of internal fixed weight 110. The shape of the weights 110 is shown as an annular disk. However, many different shapes and methods of achieving the internal fixed weight could be applied to achieve proper use of the device. This also allows devices to be produced that meet the needs of many different sports training applications.

Figure 3A:
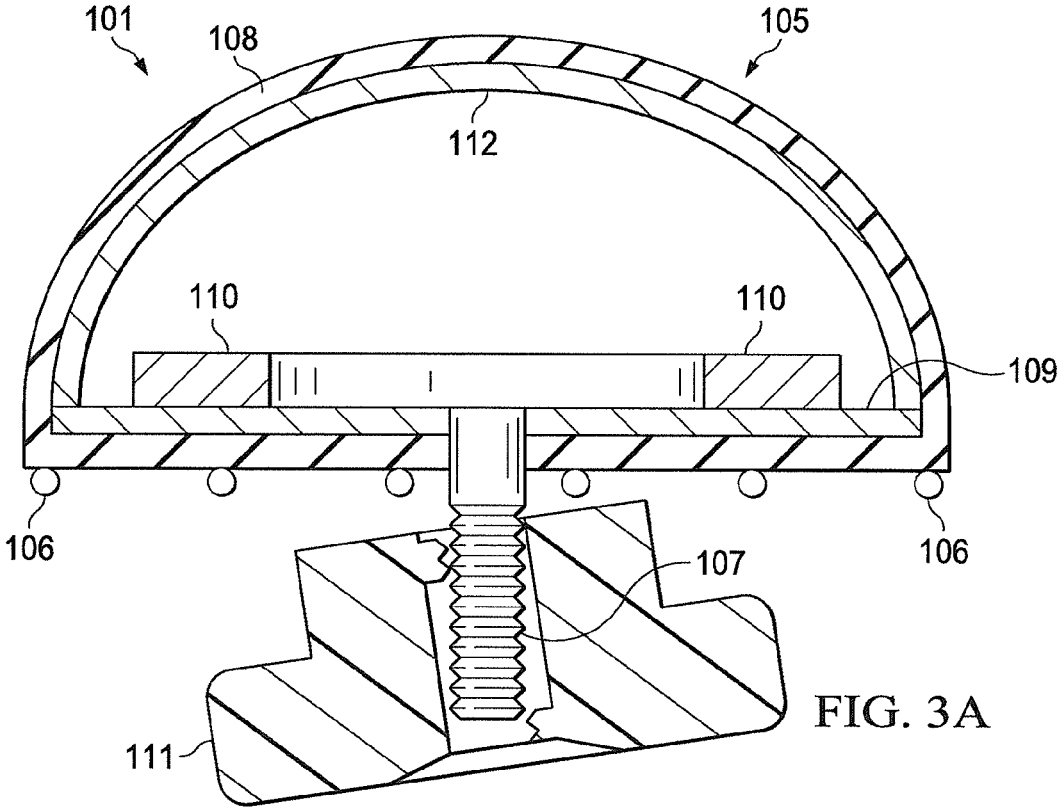
FIG. 3 illustrates a quick release attachment knob system for the swing weight training device of FIG. 1.
Figure 3B:
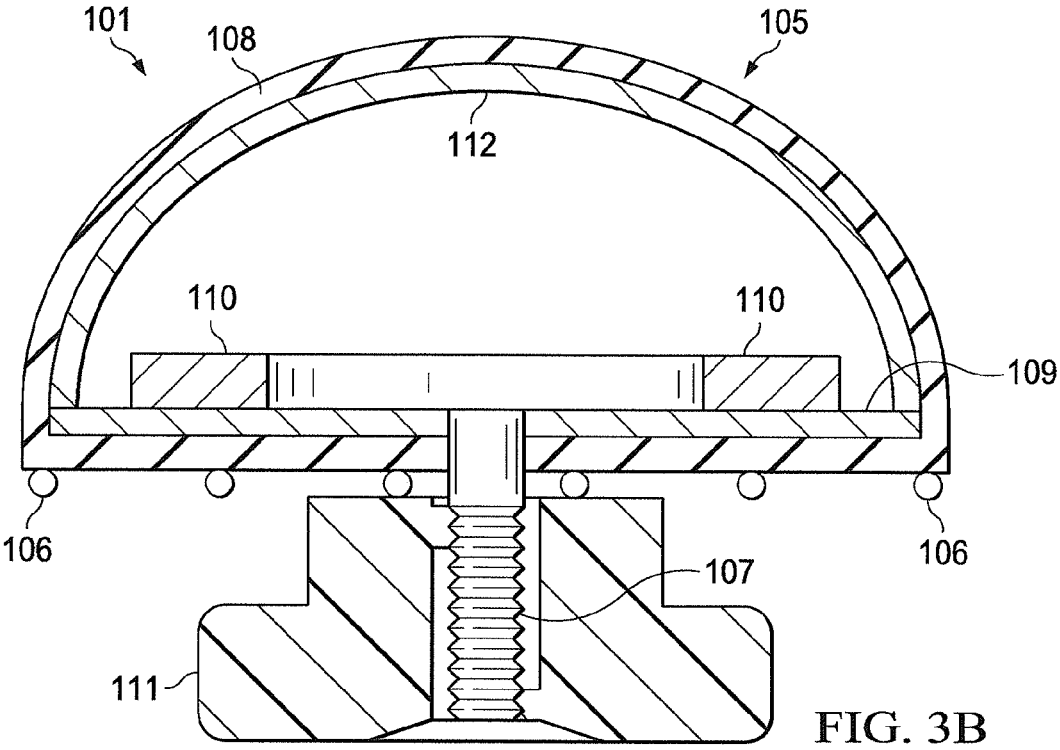

FIG. 3 illustrates a quick release attachment knob system for the swing weight training device of FIG. 1. The quick release attachment knob provides a mechanism to very rapidly apply the desired clamping force, then also allow quickly release the same device from the racket. The interior of knob 111 includes partially circumferential threads at different locations along the length of the opening through know 111, so that the threaded stud 107 passes freely at an angle through that opening. The threaded stud 107 of the primary weight 105 is passed through the racket strings 106 at the desired location. Then, to attach, the knob 111 is tilted over the top of the threaded stud 107. When in position, the knob is tilted upright into a straight position (so that the axis is aligned with the axis of the stud 107) for engaging of the threads on knob 111 and threads of the stud 107. The knob 111 will then have to be turned only by a fraction to apply the clamping force necessary to compress the weight's elastomeric coating 108 onto the racket strings 106, securing the device in the position necessary. The process is reversed to remove the device.

Figure 4:
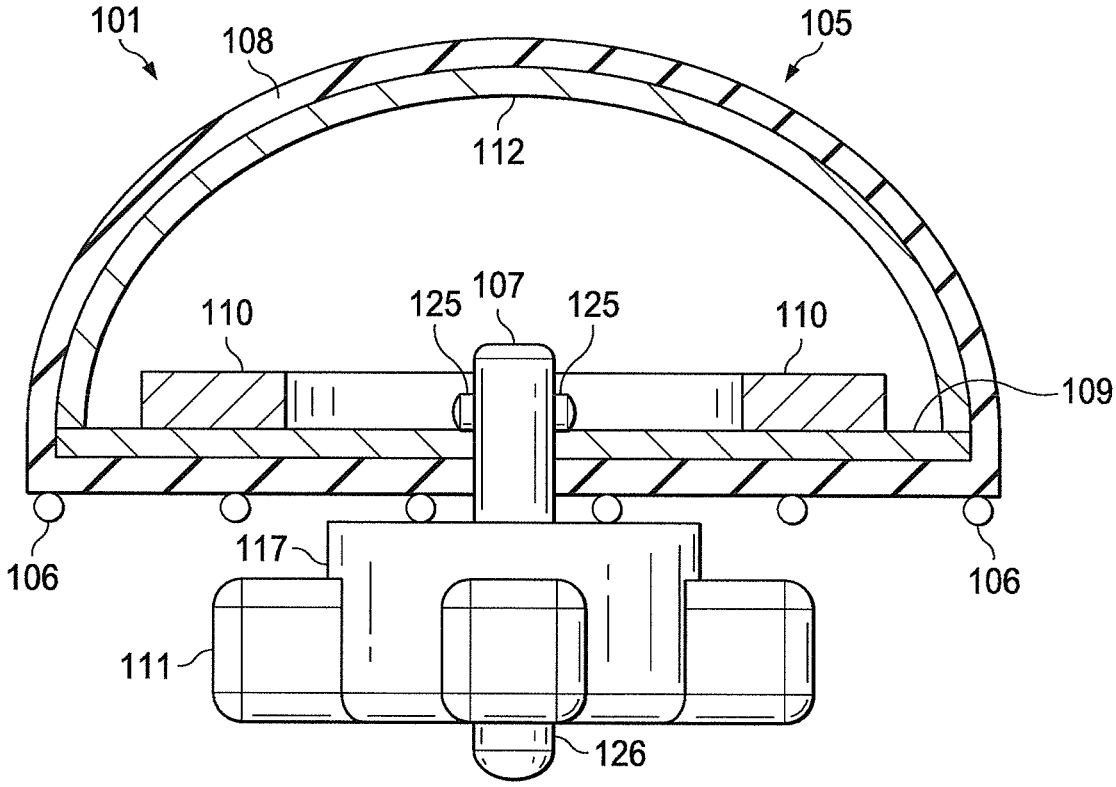
FIG. 4 illustrates use of a positive locking (or push button) pin system to obtain the quick attachment for the swing weight training device of FIG. 1.

FIG. 4 illustrates use of a positive locking (or push button) pin system to obtain the quick attachment for the swing weight training device of FIG. 1. FIG. 4 shows an application of the swing weight device 105 attached to the racket strings 106 using a positive locking (or push button) pin system to obtain quick attachment. This provides a convenient but secure method to attach or remove the device from the face of the racket. Positive locking pins 125 have a push button 126 coupled through the interior of shaft 107 to positive locking pins 125, that initiates and controls ball action and retraction. To operate, the push button 126 on the knob 111 is depressed, retracting the locking pins 125. The stud 107 is inserted through a corresponding hole in the swing weight 105. The knob assembly 111, 117 is pressed against the weight, compressing the racket strings 106 into the elastomeric coating 108. The push button 126 is then released allowing the locking pins 125 to catch on the flat bottom plate 109 of the primary weight securing the device. A washer 117 may be included between the knob 111 and the strings 106 to enhance the hold and attachment of the device to the strings 106.

The present disclosure describes a racket sport swing weight training device designed to be quickly and easily attached and removed. The advantages presented by this disclosure include an attachment knob or handle that provides a knurled or ridged easy gripped knob or handle to enhance the ease of attachment and removal of the device, together with a smooth, low friction surface that will not bind or grab the strings. This allows a surface that will easily slides against the strings aiding in enhanced attachment and removal of the device without damaging the strings. In addition, a quick attachment and release mechanism option designed into the attachment knob or stud system, which may be either a quick release knob design or a positive locking pin application. These provide a mechanism to very rapidly apply the desired clamping force then also allow quick release of the device from the racket.

The advantages presented by this disclosure also include an elastomeric coating integral to the weighted portion of the device that provides a soft pliant over-mold creating a high friction surface to prevent the weight from moving and a soft, resilient surface protecting the racket strings and providing a soft backing to the opposing attachment knob. In addition, the elastomeric covering provides a protective covering on the attachment stud that protects the strings from the wear caused by the attachment threads and a tough protective cover on the outside of the weight that prevents damage to the weight when dropped or banged. The resilient surface on the outside of the weight can reduce injury to other surfaces or objects when the weight contacts other objects in either use or storage.

The advantages presented by this disclosure further include a simple fixed mass that can be located anywhere on the face of the racket as desired to aid in training. The simple fixed weight allows the centerline of the weight to be asymmetric to the centerline of the racket, providing the ability for the weight to be forward or rearward of the center line of the racket for enhanced training options. The simple fixed weight also provided simple and quick operation.

The design in the present disclosure is applicable to being produced with multiple different weights and shapes to meet the specific needs of each sports application or desired training regimen. This disclosure thus significantly differs from the current art in the field and builds upon and enhances the prior proposed designs in the field. The designs that attach or clamp to the strings when used provide a positive secure connection to the racket enhancing the overall performance of the device.

The current disclosure enhances this state of the art in multiple aspects. The added elastomeric over-mold provides protection of the device and other object as well as protecting the strings from the stud. An additional enhancement over the prior art is improved functionality by the use of a knob or quick release attachment and removal method to aid in the product use.

The following definitions apply to certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. To the extent definitions for certain words and phrases are provided throughout this patent document, those of ordinary skill in the art should understand that in many, if not most, instances, such definitions apply to prior as well as future uses of such defined words and phrases.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A sports racket weight training device, comprising:

a primary weight assembly having at least a first surface covered with a pliable elastomeric coating; and an opposing knob or handle configured to receive a portion of an attachment stud projecting from the primary weight assembly and to hold the first surface of the primary weight assembly against sports racket strings, wherein the elastomeric coating extends onto an attachment nut.

2. The device of claim 1, wherein the elastomeric coating extends onto a portion of the attachment stud proximate to the first surface.

3. The device of claim 1, wherein the attachment stud projecting from the primary weight assembly incorporates a quick release mechanism.

4. The device of claim 3, wherein the quick release mechanism includes threads engaging counterpart threads on the attachment stud when the opposing knob is aligned with an axis of the attachment stud.

5. The device of claim 1, wherein the primary weight assembly contains at least one weight and is configured to receive one or more additional weights.

6. A sports racket weight training device, comprising:

a primary weight assembly having at least a first surface covered with a pliable elastomeric coating;

an opposing knob or handle configured to receive a portion of an attachment stud projecting from the primary weight assembly and to hold the first surface of the primary weight assembly against sports racket strings; and a quick release mechanism associated with the attachment stud and including threads with positive locking pins extending and retracting based on a position of a push button on the opposing knob.

7. The device of claim 6, wherein the elastomeric coating extends onto a portion of the attachment stud proximate to the first surface.

8. The device of claim 6, wherein the attachment stud projecting from the primary weight assembly incorporates the quick release mechanism.

9. The device of claim 8, wherein the quick release mechanism includes threads engaging counterpart threads on the attachment stud when the opposing knob is aligned with an axis of the attachment stud.

10. The device of claim 6, wherein the primary weight assembly contains at least one weight and is configured to receive one or more additional weights.

11. A sports racket fixed weight training device, comprising:

an elastomeric coated fixed primary mass configured to be attached to strings of a sports racket, wherein the elastomeric coating extends onto an attachment nut.

12. The device of claim 11, wherein the elastomeric coating extends onto an attachment stud projecting from the fixed primary mass.

* * * * *